US005707068A

United States Patent [19]

Bradfield

[11] Patent Number: 5,707,068

[45] Date of Patent: Jan. 13, 1998

[54] IN-LINE SKATEBOARD

[76] Inventor: Athol George Bradfield, Box 48226, Vancouver, British Columbia, Canada, V7X 1N8

[21] Appl. No.: 561,336

[22] Filed: Nov. 21, 1995

[51] Int. Cl.[6] ..... A63C 17/04

[52] U.S. Cl. ..... 280/87.042; 280/11.28

[58] Field of Search ..... 280/11.19, 11.22, 280/11.27, 11.28, 842, 843, 878.01, 87.042

[56] References Cited

U.S. PATENT DOCUMENTS

| | | | |
|---|---|---|---|
| 2,064,690 | 12/1936 | Schavone . | |
| 3,252,713 | 5/1966 | Heller | 280/87.042 |
| 3,622,172 | 11/1971 | Goodwin . | |
| 4,047,727 | 9/1977 | Holladay et al. . | |
| 4,062,557 | 12/1977 | Roden . | |
| 4,382,605 | 5/1983 | Hegna . | |
| 5,096,225 | 3/1992 | Osawa . | |
| 5,125,687 | 6/1992 | Hwang . | |
| 5,135,244 | 8/1992 | Allison . | |
| 5,160,155 | 11/1992 | Barachet . | |
| 5,419,570 | 5/1995 | Bollotté . | |
| 5,540,455 | 7/1996 | Chambers | 280/11.28 X |
| 5,549,331 | 8/1996 | Yun et al. | 280/87.042 X |
| 5,551,713 | 9/1996 | Alexander | 280/11.27 X |
| 5,553,874 | 9/1996 | Schouten et al. | 280/11.28 |

OTHER PUBLICATIONS

Armstrong, Gazette entry for U.S. Pat. No. 4,795,181, date unknown.

Shols, Gazette entry and abstract for U.S. Pat. No. 4,886, 298, issued Dec. 12, 1989.

*Primary Examiner*—Brian L. Johnson
*Assistant Examiner*—Michael Mar
*Attorney, Agent, or Firm*—Brian G. Kingwell

[57] ABSTRACT

A skateboard has a plurality of in-line wheels rotatably mounted on the front end of the board and rear wheels disposed on either side of the rear end of the board. The board may have a resiliently flexible portion between the in-line and rear wheels. The in-line wheels may be supported between a pair of parallel lateral flanges or they may be supported on a single flange that splits each in-line wheel. The rear wheels may be mounted on a coil and leaf spring suspension, on a transverse shaft or in housings at the rear end of the board. The rear wheels may be tapered.

3 Claims, 4 Drawing Sheets

IN-LINE SKATEBOARD

TECHNICAL FIELD

The invention is in the field of skateboards. More particularly, the invention relates to the arrangement of wheels on skateboards.

BACKGROUND ART

It is generally accepted that the recreational sport of skateboarding developed as an offshoot of surfing sometime in the late 1960s. As such, the skateboard was, and still is, intended to provide a similar athletic experience to surfing. In recent years, the sport of skateboarding has become popular throughout the industrialized world. This acceptance of the sport is due in large part to technological developments which have improved the ride and handling of skateboards so that they better approximate the smooth ride of a surfboard on water.

In its most common current form, a skateboard typically includes a board 6–12 inches wide and 2–3 feet long. Boards are often made of wood or fibreglass. Two sets of two polyurethane wheels are typically mounted on the bottom side of the board, one set of wheels being attached towards the front end of the board, the other set of wheels being attached towards the rear end of the board. Each set of wheels is typically mounted on an axle in a pivoting truck assembly. The truck resiliently pivots about its connection with the board and thereby displaces the axle from its usual orientation perpendicular to the median longitudinal axis of the skateboard. The,axles are displaced by tilting the board so that the axles each come to lie on a radius of a circle, thereby orienting the wheels so that they steer the skateboard along the circumference of the circle. This arrangement of wheels provides favourable cornering characteristics along with stability, enabling skilled skateboarders to negotiate smooth, sharp turns in rapid succession.

At one time, roller skates were commonly provided with trucks similar to the trucks found nowadays on most skateboards. Typically, roller skates of this design had two sets of two wheels mounted on pivoting trucks, with the four wheels being disposed essentially at the corners of a rectangle. This old design has given way in popularity recently to an in-line roller blade configuration, with a plurality of wheels arranged along the median longitudinal axis of the roller skate. An in-line arrangement of wheels provides for more speed and manoeuvrability than the rectangular arrangement of wheels on pivoting trucks. However, the in-line configuration naturally sacrifices a degree of stability to achieve improved manoeuvrability.

A variety of skateboard designs have appeared in which an in-line wheel configuration has been adopted. U.S. Pat. No. 5,419,570 issued May 30, 1995 to Bollotté discloses a skateboard having in-line wheels. U.S. Pat. No. 4,382,605 issued May 10, 1983 to Hegna discloses an arrangement of steerable in-line wheels that may be adapted for use on a skateboard. Similarly, U.S. Pat. No. 3,622,172 issued Nov. 23, 1971 to Turf Ski, Inc. shows a land skier with a plurality of in-line ball bearing rollers. The disadvantage of reduced stability that characterizes in-line roller blade skates is accentuated when an in-line configuration is used on a skateboard. With roller blade skates, a user is at least able to balance on two skates that are laterally disposed. With an in-line skateboard, there is no such opportunity to off-set the inherent instability of an in-line design.

There is a need for a skateboard design that combines the speed and manoeuvrability of an in-line wheel arrangement with the handling and stability of laterally disposed wheels. It would be advantageous if such a design exhibited handling characteristics that better mirrored the handling of a surfboard on water.

DISCLOSURE OF INVENTION

In accordance with the invention, a skateboard includes a board, a plurality of in-line wheels and at least two rear wheels. The in-line wheels are rotatably mounted on the bottom side of the board, towards the front end of the board, and are arranged longitudinally along the median longitudinal axis of the board. A first rear wheel is rotatably mounted behind the in-line wheels on the left side of the board towards the rear end of the board. A second rear wheel is rotatably mounted behind the in-line wheels on the right side of the board towards the rear end of the board. The skateboard can roll over a surface on one or more of the wheels and the skateboard is steerable when its rolling by tilting the board about the median longitudinal axis. The skateboard may be steered to the left by tilting the left side of the board downwards. Similarly, the skateboard may be steered to the right by tilting the right side of the board downwards. The in-line wheels and the first wheel come into contact with the surface when the skateboard steers to the left and, similarly, the in-line wheels and the second wheel may come into contact with the surface when the skateboard steers to the right.

A portion of the skateboard may be resiliently flexible, to allow the board to bend about a transverse axis. The resiliently flexible portion of the board that allows this flexibility may be between the part of the board where the in-line wheels are mounted and the part of the board where the rear wheels are mounted. The resiliently flexible portion of the board may be made of a transverse hinge mounted in the board connecting the front and rear ends of the board.

The rear wheels of the board may be tapered so that they are wider near the median longitudinal axis of the board than they are further from that axis. In other words, the outer circumference of the wheels may be smaller than the inner circumference of the wheels.

The rear wheels of the skateboard may be mounted higher off the ground that the in-line wheels. In effect, the horizontal plane that is tangential to the lowest circumferential surface of the left and right rear wheels may be above the horizontal plane that is tangential to the lowest circumferential surface of the in-line wheels.

The wheels may be mounted on a leaf and coil spring suspension. The front end of the leaf spring may be attached to the board and the back end of the leaf spring may be attached to the rear wheels and to the coil spring.

The parts of the skateboard may be sold individually or together as a kit with instructions for making a skateboard in accordance with the invention. In particular, the in-line wheel assembly can be sold in a package with labelling that indicates that the in-line wheel assembly can be mounted on a skateboard. The in-line wheel assembly may be sold this way with a frame that is adapted for mounting the in-line wheel assembly on a planer surface, such as a skateboard.

BEST MODE(S) FOR CARRYING OUT THE INVENTION

Figure 1:
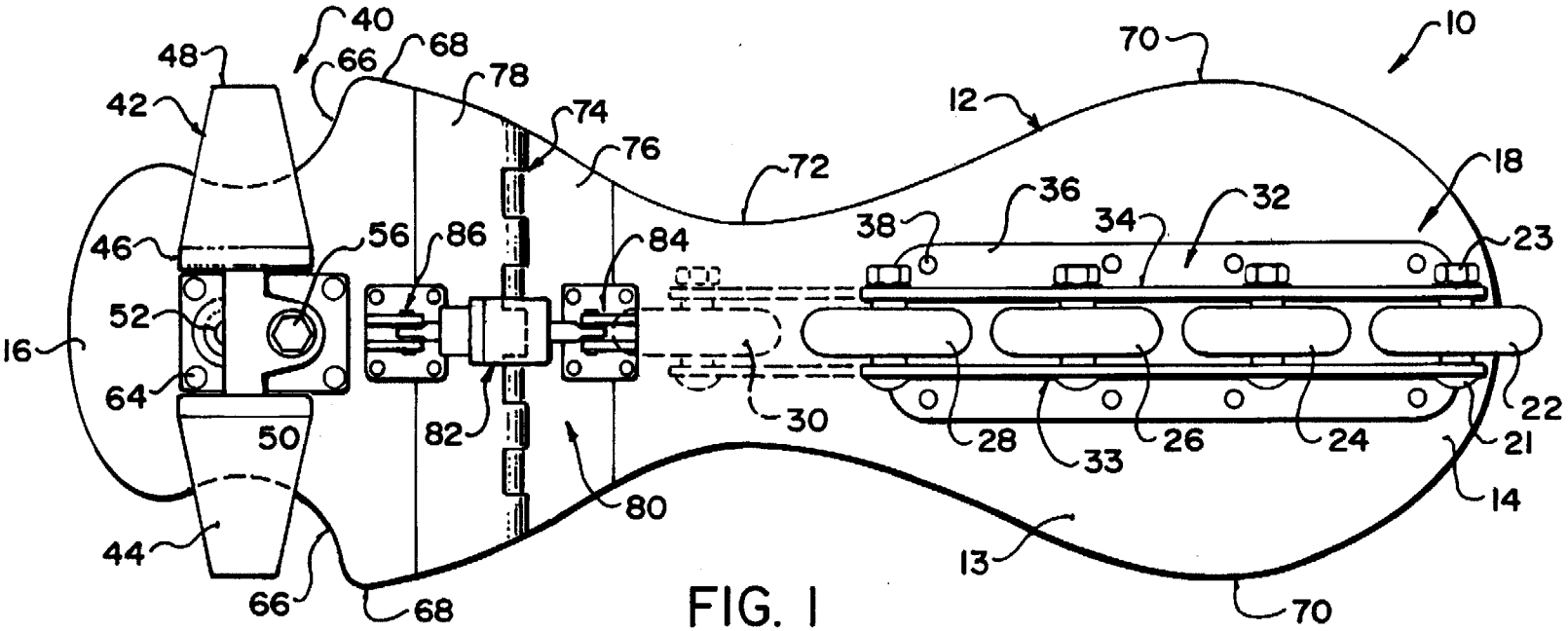
FIG. 1 is a bottom plan view showing a skateboard of the invention with an in-line wheel assembly and a rear wheel assembly.
Figure 2:
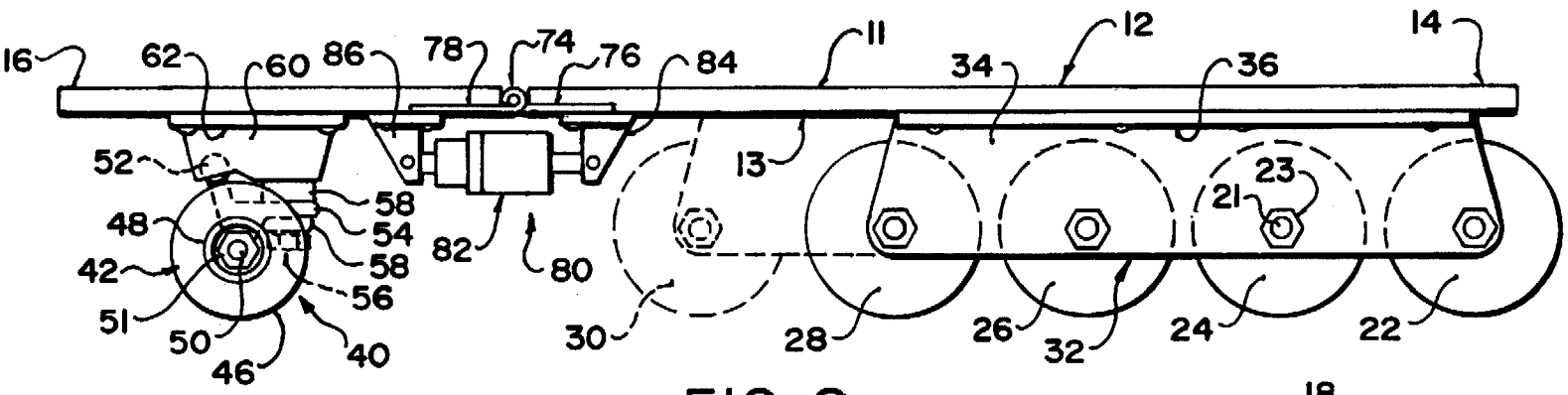
FIG. 2 is a side elevation view showing the skateboard of FIG. 1.

FIGS. 1 and 2 show skateboard 10 comprised of board 12, in-line wheel assembly 18 and rear wheel assembly 40. A hinge 74 connects the front end 14 and rear end 16 of board 14. A resilient housing 82 supports board 12 in the area of hinge 74. In this description, the left and right sides of skateboard 10 are as viewed looking down from the top side of the board and towards the front end of the board.

Supporting frame 32 of in line wheel assembly 18 is comprised of plate 36 and downwardly depending flanges 34, 33. Frame 32 is fastened to the bottom side 13 of the front end 14 of board 12 by bolts 38. Apertures (not shown) in downwardly depending flanges 34, 33 support axle bolts 21 which are secured by axle nuts 23. Wheels 22, 24, 26 and 28 are rotatably mounted on axle bolts 21 and disposed longitudinally along the median longitudinal axis of board 12. An alternative fifth in-line wheel 30 is shown by phantom lines in FIGS. 1 and 2.

Integral body 60 and plate 62 of rear wheel assembly 40 are attached by bolts 64 to the rear end 16 of board 14. Integral pivoting member 52, flange 54 and axle 50 are fastened to body 60 by bolt 56 which passes through an aperture in flange 54 and is threadably received in body 60. The upper end of pivoting member 52 is received in a socket in body 60. Resilient rings 58 are mounted on bolt 56 on either side of flange 45, resiliently biasing pivoting member 52 and flange 54 in place in body 60.

Rear wheels 44, 48 are removably secured on axle 50 by wheel nuts 51. Rear wheel 42 is rotatably mounted behind in-line wheels 22, 24, 26 and 28 on the right side towards the rear end 16 of board 12. Rear wheel 44 is rotatably mounted behind in-line wheels 22, 24, 26 and 28 on the left side towards the rear end 16 of board 12. Rear wheels 44, 48 may have an inner flat portion 46 and may be tapered outwardly towards outer portion 48, so that the circumference of the portion of the wheel closest to the median longitudinal axis of board 12 is greater than the circumference of the portion of the wheel furthest from that axis.

Figure 3:
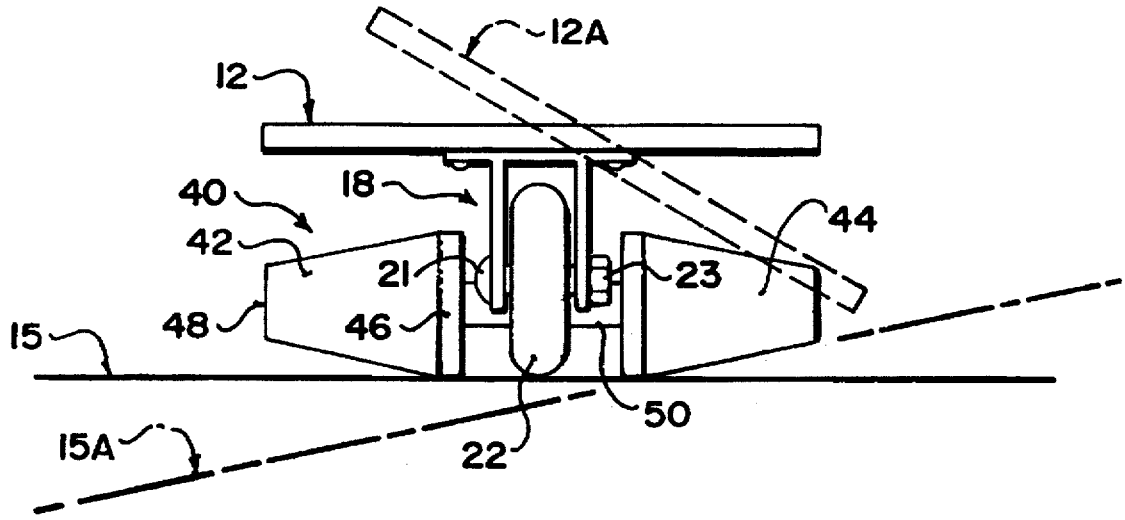
FIG. 3 is a front elevation view of the skateboard of FIGS. 1 and 2, showing the skateboard tilted in a turn.

Tilting board 12, as shown in FIG. 3 by dashed lines 12A, causes axle 50 to rotate in a horizontal plane about the axis of bolt 56 while pivoting member 52 swivels in the socket (not shown) in body 60. The rotational displacement of axle 50 steers skateboard 10 by turning rear wheels 42, 44. Tilting the left side of board 12 downwards causes skateboard 10 to turn to the left. Similarly, Tilting the right side of board 12 downwards causes skateboard 10 to turn to the right. FIG. 3 shows ground plane 15.

The combination of front in-line wheel assembly 18 with laterally disposed rear wheels 42, 44 provides the skateboard of the present invention with surprising handling characteristics. The in-line wheel assembly 18 imparts improved lateral stability to skateboard 10 in turns, so that skateboard 10 is less likely to "break away" from the turn. At the same time, rear wheels 42, 44 impart a degree of stability to skateboard 10 and facilitate turning by their steerable facility.

When board 12 is tilted sharply to one side, the tapered surface of the rear wheel on that side may come into engagement with the surface upon which skateboard 10 is riding, as shown by ground plane 15A in FIG. 3. In this way, the taper of rear wheels 42, 44 assists a rider in making sharp turns by ensuring that a large surface of the rear wheel is in contact with the surface at the sharpest part of a turn.

Hinge 74 is adhesively attached to board 12 by plates 76, 78. Hinge 74 allows skateboard 10 to flex under pressure. The extent of flex about hinge 74 is moderated by resilient coupling 82 which is mounted to board 12 by brackets 84, 86 on either side of hinge 74. The resilient flex of board 12 about hinge 74 acts as a shock absorber and assists in keeping the wheels of this embodiment on the ground at all times.

As shown in FIG. 1, a narrow waist portion 72 of board 12 may be formed by converging rear side edges 68 and front side edges 70. A narrow waist portion 72 of board 12 may serve a similar function as resiliently biased hinge 74. It will be appreciated that the dimensions and materials of board 12 may be varied in a number of ways in order to achieve a similar result. For example, the thickness of board 12 may be varied in the vertical dimension to modulate the flexibility of portions of board 12.

Figure 4:
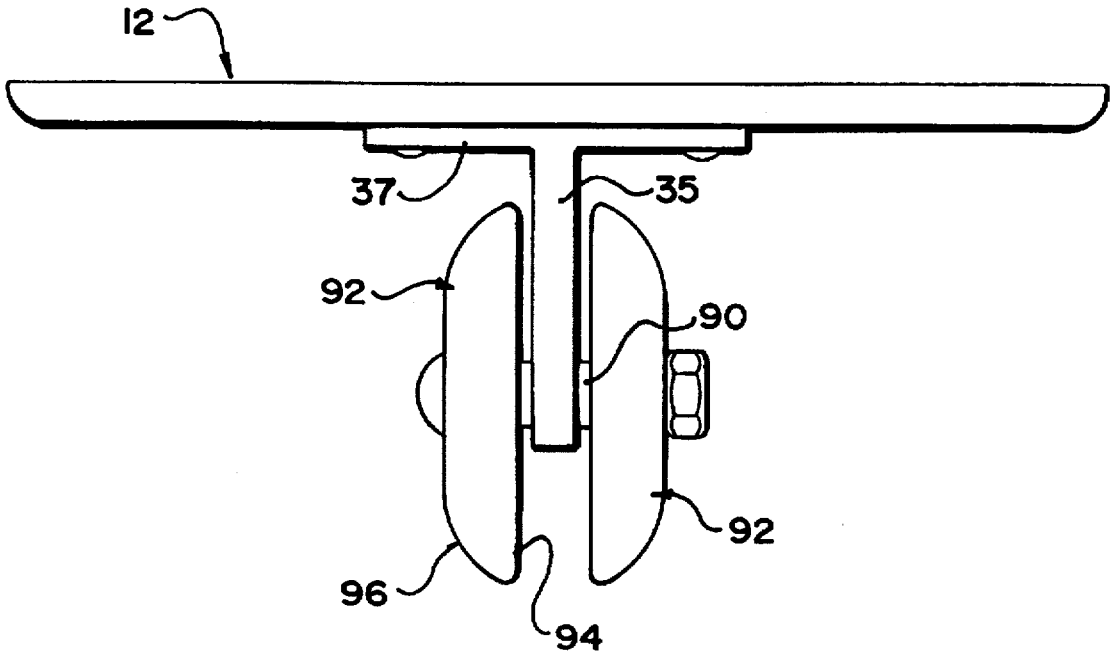
FIG. 4 is a front elevation view of a skateboard of the invention showing a split wheel in-line wheel assembly.

FIG. 4 shows a front view of an alternative in-line wheel assembly in which rigid vertical flange 35 depends downwardly from horizontal plate 37. Axles 90 are supported by flange 35. Pairs of split wheels 92 with vertical inner faces 94 and curved outer edges 96 are rotatably mounted on axles 90. This alternative split wheel 92 may facilitate making sharp turns with skateboard 10, since there are no downwardly depending flanges 34, 33 on the lateral sides of the in-line wheels (as there are in the embodiment of FIGS. 1 and 2). The curved outer edges 96 of split wheels 92 also facilitate turning because they tend to maintain a constant degree of contact with a surface as board 12 tilts into a turn.

Figure 5:
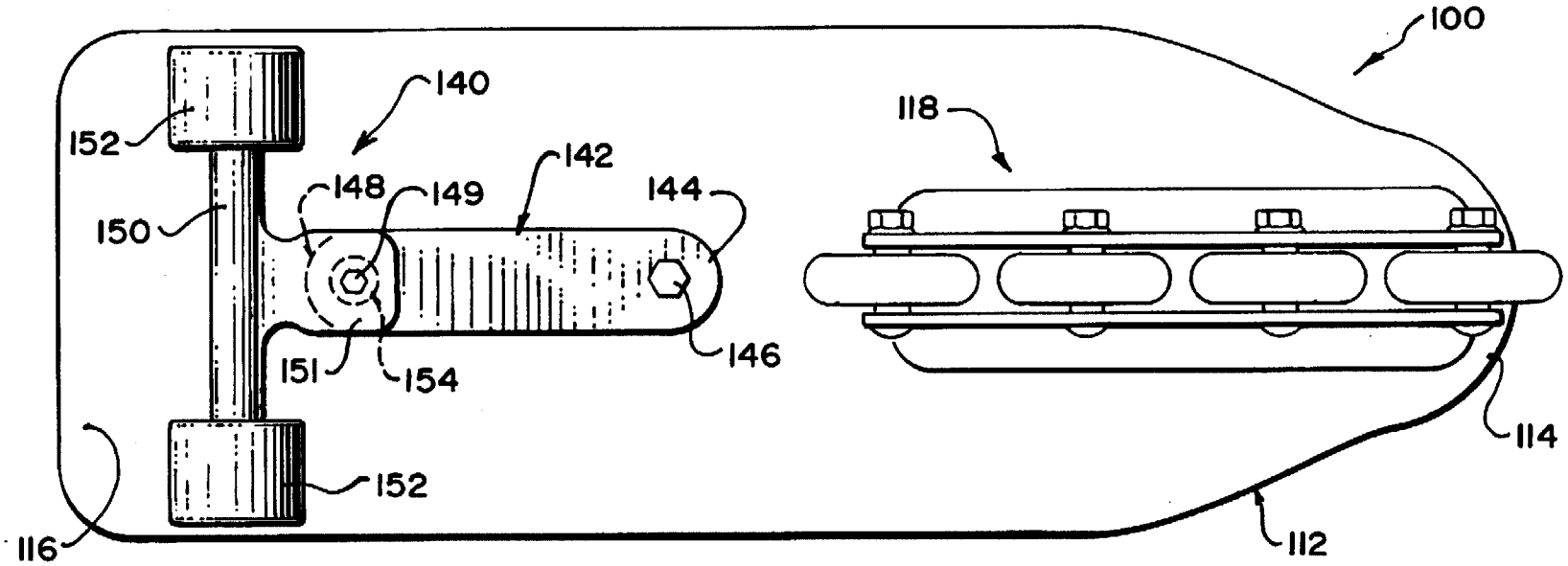
FIG. 5 is a bottom plan view of an alternative skateboard of the invention showing a rear wheel assembly with a leaf spring and coil spring suspension.
Figure 6:
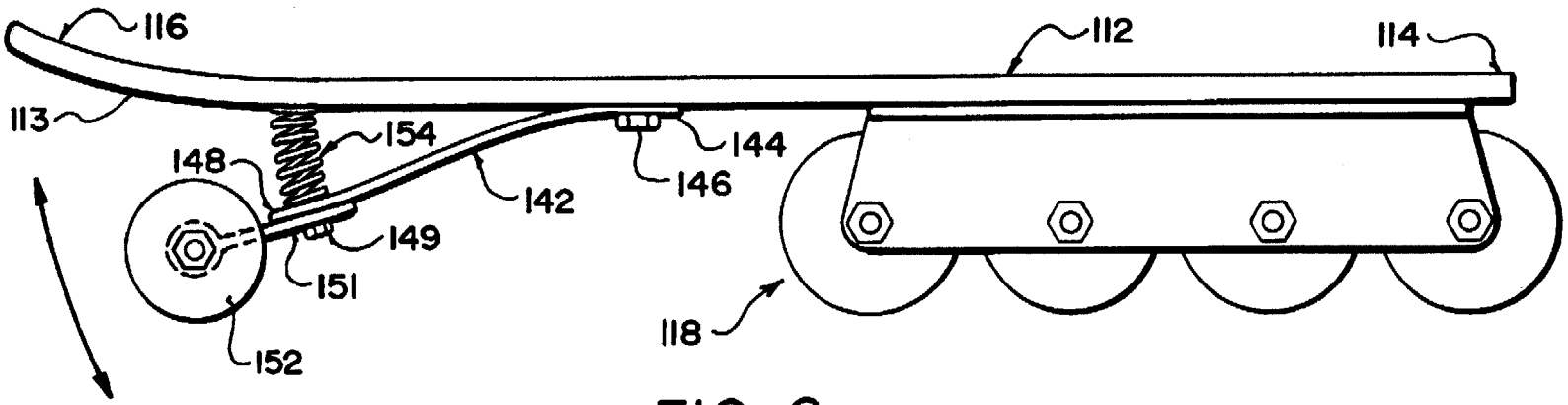
FIG. 6 is a side elevation view showing the skateboard of FIG. 5.

FIGS. 5 and 6 show an alternative embodiment in which rear wheel assembly 140 is attached to board 112 by leaf spring 142. Outer end 148 of leaf spring 142 is biased away form rear portion 116 of board 112 by coil spring 154. Inner end 144 of leaf spring 142 is attached to the central portion of the bottom side 113 of board 100 by bolt 146 (or other fastening means). Axle 150 is rigidly affixed to axle plate 151. Axle plate 151 is pivotally mounted to outer end 148 of leaf spring 142 by bolt 149. Coil spring 154 may be attached to outer end 148 of leaf spring 142 at the pivotal axis defined by bolt 149. Wheels 152 are rotatably mounted on axle 150. Wheels 152, axle 150 and axle plate 151 may pivot about the vertical axis of bolt 149 to assist in steering skateboard 100. Resilient pivot stop means, not shown, may be used to maintain the pivotal alignment of axle plate 151. The coil spring 154 and leaf spring 142 allow rear wheel assembly 140 to travel vertically. This capacity for shock absorption helps to ensure that as many wheels as possible remain in contact with the surface over which skateboard 100 travels.

Figure 7:
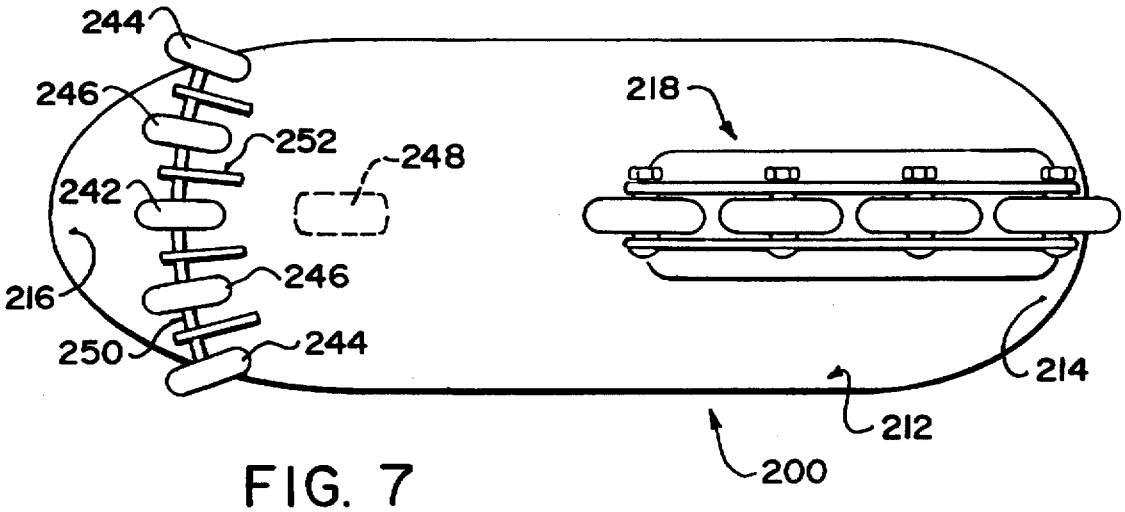
FIG. 7 is a bottom plan view showing an alternative skateboard of the invention showing a rear wheel assembly with a plurality of wheels disposed on a shaft.
Figure 8:
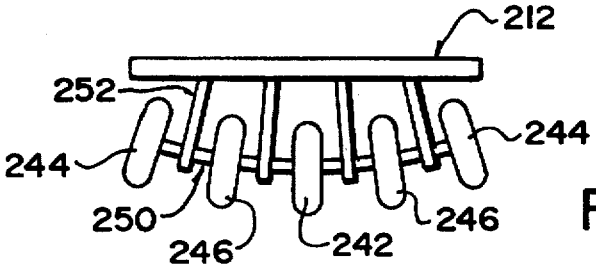
FIG. 8 is a rear elevation view of the skateboard of FIG. 7.

FIGS. 7 and 8 show an alternative embodiment of skateboard 200 with in-line wheel assembly 218 mounted towards the front end 214 of board 212. Rear wheel assembly 240 mounted towards the rear end 216 of board 212 comprises a plurality of spaced apart wheels 242, 244 and 246 disposed on shaft 250. Shaft 250 is supported on radial members 252 depending downwardly from the rear end 216 of board 212.

As shown in rear elevation in FIG. 8, shaft 250 is adapted to arrange wheels 242, 244 and 246 along the circumference of a curve, with outer wheels 244 being closer to board 212 than intermediate wheels 246. Intermediate wheels 246 are in turn closer to board 212 than central wheel 242. As shown in FIG. 7, when viewed in plan, the rotational axes of wheels 242, 244 and 246 are different. The rotational axis of outer wheels 244 is more oblique to the longitudinal axis of skateboard 200 than are the rotational axes of intermediate wheels 246. The rotational axis of central wheel 242 is perpendicular to the longitudinal axis of skateboard 200. The disposition of wheels 242, 244 and 246 is such that skateboard 200 may be steered by tilting board 212. Outer wheels 244 provide for a greater degree of turn than intermediate wheels 246. Central wheel 242 is aligned with in-line wheel assembly 218 so that skateboard 200 will tend to travel in a straight line when it is not tilted. An alternative central wheel 248 is shown by phantom lines in FIG. 7. It will be appreciated that intermediate wheels 246 may be dispensed with or a greater number of such wheels may be added, depending on the desired characteristics of board 200.

Figure 9:
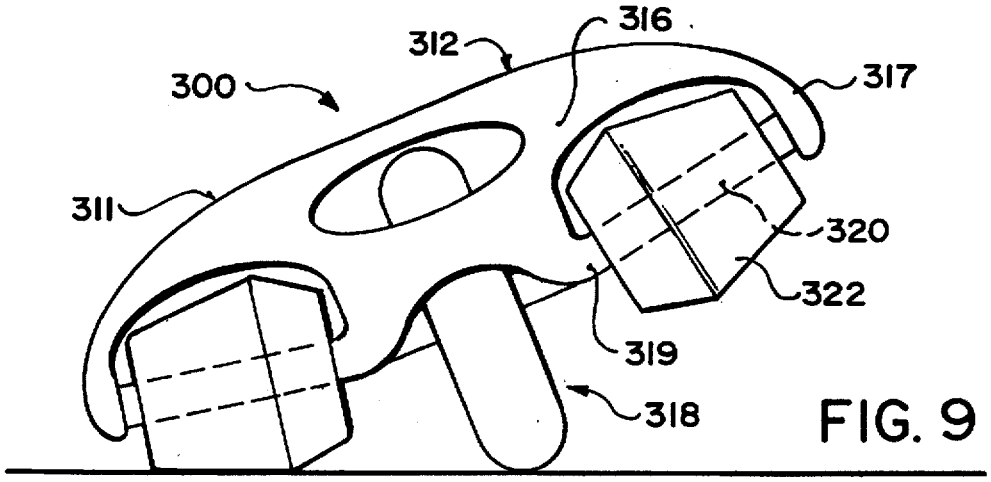
FIG. 9 is a rear elevation view of an alternative skateboard of the invention showing rear wheels mounted on axels in a housing.

FIG. 9 shows an alternative skateboard 300 with an in-line wheel assembly 318 mounted towards front end 314 of board 312. Integral outer axle supports 317 depend downwardly from the rear end 316 of board 312. Axles 320 are mounted in axle supports 317. Wheels 320 are rotationally mounted on axles 320 within integral housings formed by the rear end 316 of board 312. The horizontal plane that is tangential to the lowest circumferential surface of the left and right rear wheels 320 is above the horizontal plane that is tangential to the lowest circumferential surface of the in-line wheels 318.

It will be appreciated that the components of the skateboard of the invention may be sold individually or as a package along with instructions for assembling a complete skateboard of the invention. In particular, in-line wheel assembly 18 comprising frame 32 mountable on a planar surface may be sold in packaging which indicates that wheel assembly 18 may be mounted on a skateboard.

In an alternative embodiment, the first and second rear wheels may be mounted on a single axle with a third wheel interposed between the first and second wheels on the axle. The axle may in turn be supported at each of its ends on a single pivoting truck. An example of an arrangement of this type is provided in U.S. Pat. No. 4,047,727, issued Sep. 13, 1977 to Holladay et al., which is incorporated herein by reference.

In an alternative embodiment, the invention may be adapted for use on a large board fitted with a windsurfer sail. In such an embodiment, the wheels may be fitted with pneumatic tires rather than solid tires. The combination of the forward in-line wheels with the left and right rear wheels may provide a ride for such a land windsurfer that simulates the ride of a windsurfer on water.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A skateboard for traversing a riding surface and adapted to support both feet of a user comprising:

a board having a front end, a rear end, a top side, a bottom side, a left side, a right side a front portion, a rear portion, and a median longitudinal axis running from the front end to the rear end dividing the left and right sides, the front and rear portions of the board being substantially planar members which are pivotal relative to each other about an intermediate transverse portion;

a plurality of in-line wheels rotatably mounted on the bottom side of the board, along the front portion of the board, the in-line wheels being longitudinally disposed along the median longitudinal axis of the board;

a pair of rear wheels rotatably mounted about an axis of rotation positioned below the bottom side of the rear portion of the board, behind the in-line wheels, the rear wheels being disposed below the left and right sides of the board, the rear wheels each having an inner end positioned closer to the median longitudinal axis of the board than an outer end of the wheel, the circumference of the inner and outer ends being different;

a rear wheel assembly steerably mounting the pair of rear wheels to the rear portion of the board, the rear wheel assembly comprising a pivoting member swivelably coupled to the board behind the axis of rotation of the rear wheels and a supporting member pivotally coupled to the board in front of the axis of rotation of the rear wheels, the pivoting member and the supporting member cooperating operatively to pivot the axis of rotation of the rear wheels in the plane of the riding surface when the board is tilted, so that when the board is moving along the riding surface, tilting the left side of the board downwards causes the rear wheels to steer the board to turn to the left, and tilting the right side of the board downwards causes the rear wheels to steer the board to turn to the right.

2. The skateboard of claim 1 wherein the intermediate transverse portion that is disposed longitudinally between the front and rear portions of the board is made of resiliently flexible material for permitting pivotal movement between the front and rear portions of the board.

3. The skateboard of claim 2 wherein the rear wheels are tapered so that the circumference of the outer end is smaller than the circumference of the inner end.

* * * * *